United States Patent [19]

Peleg

[11] Patent Number: 4,940,867

[45] Date of Patent: Jul. 10, 1990

[54] MICROWAVE COMPOSITE SHEET STOCK

[75] Inventor: Yigal Peleg, Solon, Ohio

[73] Assignee: The Stouffer Corporation, Solon, Ohio

[21] Appl. No.: 414,647

[22] Filed: Sep. 27, 1989

Related U.S. Application Data

[63] Continuation of Ser. No. 239,600, Sep. 1, 1988, abandoned.

[51] Int. Cl.[5] ..... H05B 6/80

[52] U.S. Cl. ..... 219/10.55 E; 219/10.55 F; 426/107; 426/234; 426/243; 99/DIG. 14

[58] Field of Search ..... 219/10.55 E, 10.55 F, 219/10.55 R; 426/107, 113, 241, 234, 243; 99/DIG. 14; 126/390

[56] References Cited

U.S. PATENT DOCUMENTS

| | | | |
|---|---|---|---|
| 4,190,757 | 2/1980 | Turpin et al. | 219/10.55 E |
| 4,267,420 | 5/1981 | Brastad | 219/10.55 E |
| 4,594,492 | 6/1986 | Maroszek | 219/10.55 E |
| 4,626,641 | 12/1986 | Brown | 219/10.55 E |
| 4,641,005 | 2/1987 | Seiferth | 219/10.55 E |
| 4,713,510 | 12/1987 | Quick et al. | 219/10.55 E |
| 4,777,053 | 10/1988 | Tobelmann et al. | 219/10.55 E |
| 4,891,482 | 1/1990 | Peleg et al. | 219/10.55 G |

*Primary Examiner*—Philip H. Leung

*Attorney, Agent, or Firm*—Body, Vickers & Daniels

[57] ABSTRACT

There is provided a composite sheet stock for convection heating of the surface of a food items, such as a pizza, by microwave energy. The composite sheet stock includes a layer of metal foil, such as aluminum, adhered to a microwave susceptor sheet stock having a dielectric support layer and a heater layer of microwave interactive material allowing passage of microwave energy as it is heated thereby whereby the foil is heated by conduction from the susceptor stock when the susceptor stock is subjected to microwave radiation.

5 Claims, 5 Drawing Sheets

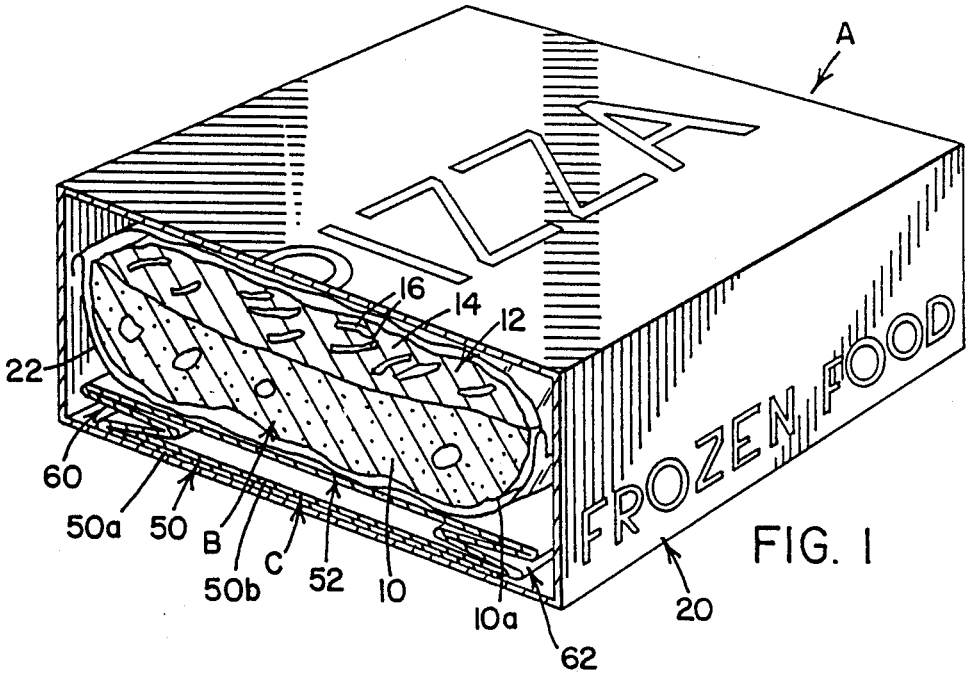
FIG. 1
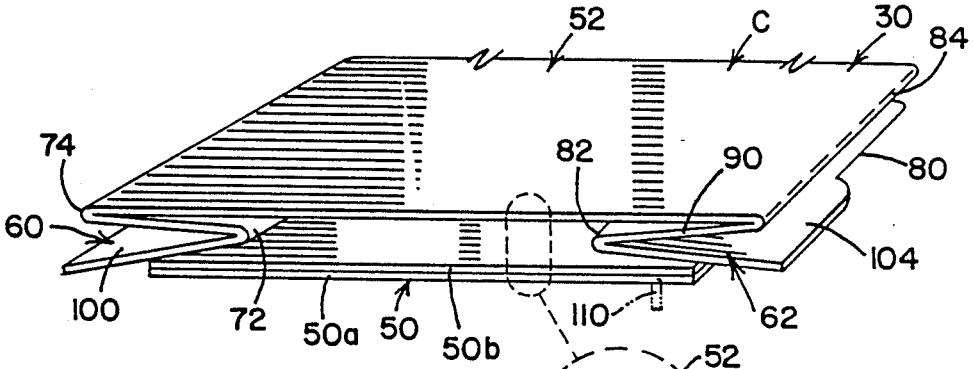
FIG. 2
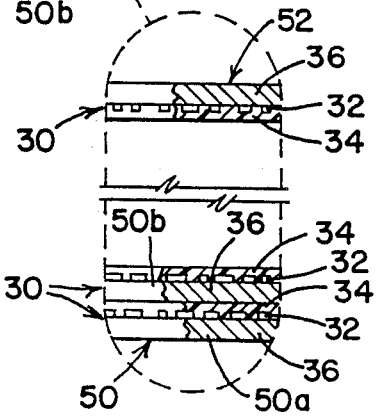

FIG. 5
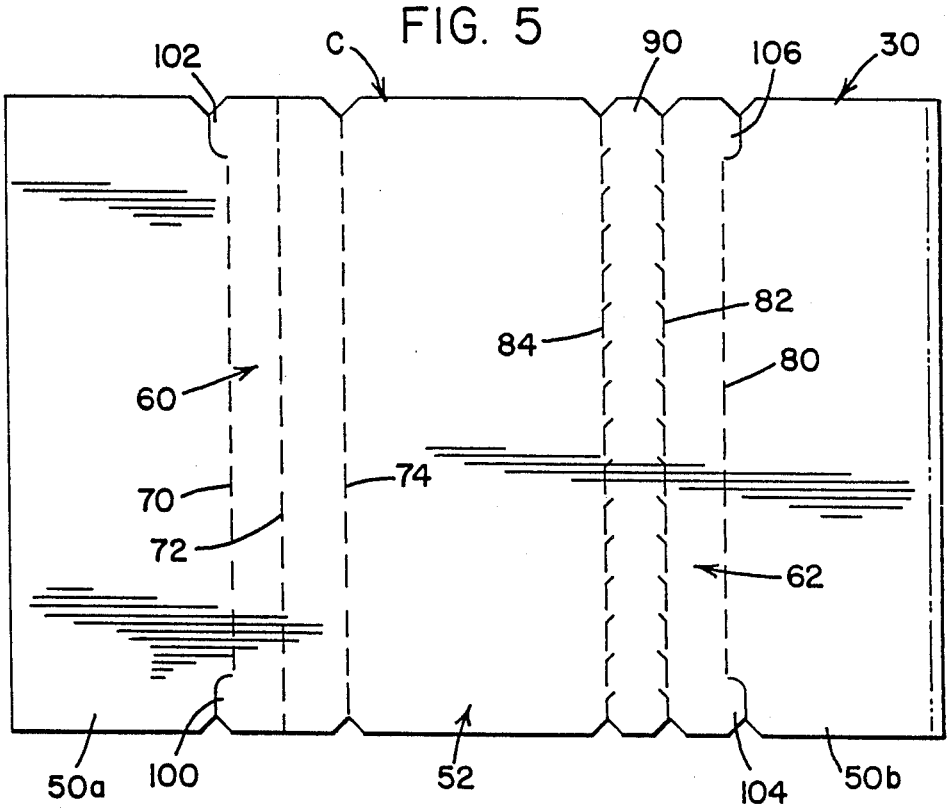
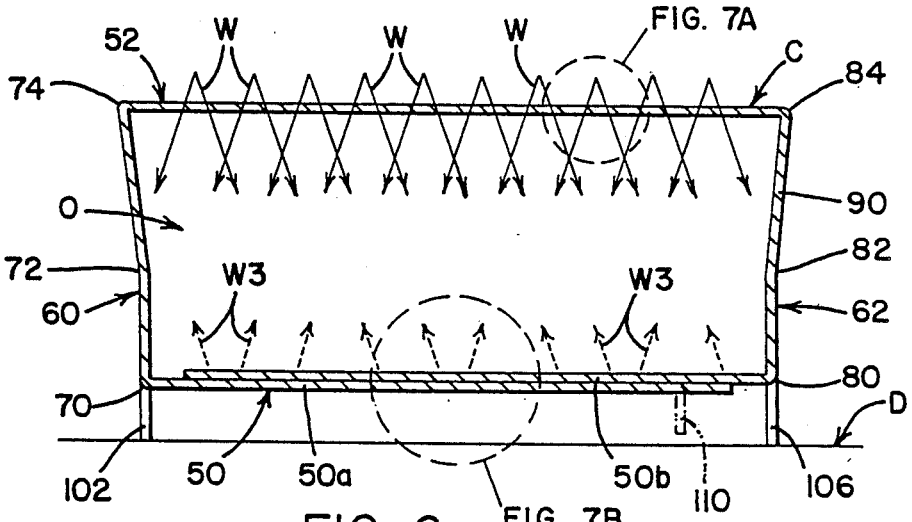
FIG. 6

MICROWAVE COMPOSITE SHEET STOCK

This is a continuation of Ser. No. 239,600 filed Sept. 1, 1988, now abandoned.

This invention relates to the art of microwave heating of food products or articles, and more particularly to a microwavable composite sheet stock to be used for a disposable microwave heating receptacle.

INCORPORATION BY REFERENCE

For the purpose of background information, the following United States patents are incorporated by reference herein: Turpin U.S. Pat. No. 4,190,757; Brastad U.S. Pat. No. 4,267,420; Maroszek U.S. Pat. No. 4,594,492; Brown U.S. Pat. No. 4,626,641; and, Seiferth U.S. Pat. No. 4,641,005. These patents relate to concepts for using special sheet stock material for microwave oven cooking of refrigerated and/or frozen food products. These patents constitute a portion of the patented prior art for background of the present invention so that details known in the art need not be repeated to understand the present invention and its novelty and substantial contribution to the field of low cost packaging for microwave reconstitution.

BACKGROUND OF THE INVENTION

The present invention is particularly applicable as a self-sustained composite sheet stock for reconstituting frozen pizza, such as elongated, rectangular sections of bread topped with pizza constituents and frozen individually. This well known product is to be reconstituted by subsequent thawing and baking by the ultimate consumer. The invention will be described with particular reference to this mass produced, consumer food product; however, it is appreciated that the invention has substantially broader applications and may be used for heating or reconstituting various food products.

One of the most popular frozen entrees is pizza constructed of a generally rectangular segment of a lower farinaceous crust layer in the form of a French bread and an upper topping layer including a mixture of various substances generally including cheese, tomato sauce and meat. The topping materials are selected to provide a variety of products for the consuming public. In the preferred embodiment, the bread is baked, cut down the middle and quartered into rectangular segments. The topping is added in an uncooked, usually frozen condition. These individual bread segments or sections are sold to the public in a frozen condition for extending their shelf life. Such layered food products or articles, for the best consumer acceptance from a taste and texture sense, should be thawed and then baked by some heating appliance into the desired reconstituted texture and condition. Due to the starch and other characteristics of the lower layer of this food substance, it has been found that high quality reconstitution can be accomplished only by heating in a convection oven. Attempts to reconstitute this type of food or pizza by microwave heating, a concept now popular with and demanded by the public, have not been commercially satisfactory. Consequently, manufacturers who have introduced microwave reconstituted pizza have had to compromise on ultimate quality. A consumer was faced with the dilemma of purchasing a microwavable pizza having a compromised ultimate quality or a high quality pizza of the type reconstituted only in a convection oven. The standard convection oven produced a crunchy, high quality crust having a dough which is crisp and a topping which is cooked to duplicate freshly purchased, hand made pizza.

When attempting to bake, cook or otherwise reconstitute frozen pizza in a microwave oven, cooking time was definitely decreased; however, the pizza lost its bread texture, resulting in almost no crispness or crunchiness. Generally the topping material was overcooked while attempting to make the crust crisp. This process produced a somewhat flaccid product which must be held some time before the pizza is self-sustaining for normal consumption and manual manipulation. Such delay in eating the pizza to decrease its flaccidity, caused the crust to become hard and brittle. Such condition is clearly unacceptable to a manufacturer of mass produced frozen pizza who was concerned about its reputation in the marketplace. Further, the product generally lost its resiliency, turned leathery and caused the hot sauces forming part of the topping to migrate into the prebaked bread cells. This further detracted from consumer acceptance of the reconstituted pizza. The consuming public was provided with the unacceptable dilemma of choosing a low quality product or a high quality product based upon the type of heating desired by the consumer.

To decrease the disparity between microwave reconstituted pizza and convection oven reconstituted pizza, some producers have attempted to prefry a standard pizza crust so the crust would be preset before being frozen. This procedure somewhat reduces the shelf life of the frozen product and has a tendency to increase its fat content. Further, such procedure is known to affect the ultimate flavor of the reconstituted product when using standard pizza crust; therefore, some producers employ added flavors to mask such flavor changes resulting from prefrying the standard pizza crust to increase the crust quality of a microwave reconstituted pizza. Such procedures are not acceptable to companies valuing high reputation or ultimate quality of their reconstituted food entrees.

In view of this situation, one of the most successful pizza products is pizza formed from baked and sliced French bread covered with uncooked ingredients and reconstituted in a convection oven instead of standard crust pizza reconstituted by a microwave oven.

To alleviate the difficulties experienced in microwave reconstitution of pizza, especially using standard crust, special packages have been developed. An early concept is suggested in Turpin U.S. Pat. No. 4,190,757 that utilized a lower susceptor sheet spaced from the bottom wall of the microwave oven onto which the lower farinaceous crust portion of the pizza was supported so that the crust portion was heated to a high temperature causing browning and crispness adjacent the lower surface of the crust. This early suggestion has now been employed by certain manufacturers of pizza in the form of a lower plate, boat or platform onto which the pizza on a standard crust is placed for reconstitution in a microwave oven. This procedure, although having some advantages, was not successful until the development of the material not suggested in Turpin U.S. Pat. No. 4,190,757; but, disclosed generally in Seiferth U.S. Pat. No. 4,641,005. When the microwave susceptor material became available in sheet stock at a low cost such as disclosed generally in Seiferth U.S. Pat. No. 4,641,005, such susceptor sheet material was used to construct the previously unsuccessful plates, boats and/or platforms suggested for reconstitution of frozen pizza. By using this new sheet susceptor material, some crispness is obtained at the lower level of the pizza crust: however, the crust remained flaccid and the sauce, forming a constituent of the topping, was overcooked because the topping was exposed to only microwave heating acting upon the many components of the topping. The remainder of the crust layer was heated in a nonuniform manner to result in a soft crust. Frozen pizza reconstituted by a microwave procedure suggested in Turpin U.S. Pat. No. 4,190,757 and employing a microwave susceptor sheet of the general type disclosed in Seiferth U.S. Pat. No. 4,641,005 is still substantially unacceptable for quality reconstitution of frozen pizza of the type using standard crust. When using a bread base for the pizza, the bread was flaccid. The lower surface of the crust, in both instances, became brown or crisp; however, the rest of the crust was still extremely crunchy. Thus, even use of the new microwave susceptor sheet material had the disadvantages of prior attempts to reconstitute pizza using standard unbaked crust or a bread base in a microwave oven. Even the use of a microwave susceptor sheet, which is well known, as a plate, platform and/or boat on or spaced from the lower wall of the microwave oven, as suggested and attempted by some manufacturers, has been unacceptable. Manufacturers have gone back to the prebaked, standard crust concept for pizza to be cooked by a microwave oven. Some of these manufacturers have packaged the pizza in a vacuum package to increase shelf life which, as mentioned before, is reduced when standard pizza crust is precooked.

In summary, even with the tremendous activity and development work by most frozen food manufacturers and producers of susceptor sheet stock all attempting to microwave reconstituted frozen pizza, there has been no successful heating arrangement on the market that produces an acceptable reconstitution procedure for frozen pizza or similar layered, curst supported food products.

SUMMARY OF THE INVENTION

The disadvantages and deficiencies of prior attempts to reconstitute a flat frozen food article, such as small sections of pizza of the type using precooked standard crust or a bread base, have been overcome by a heating receptacle using the present invention.

In accordance with a principal feature of the invention, there is provided a composite sheet stock for convection heating of the surface of a food item, such as a pizza, by microwave energy. The composite sheet stock includes a layer of metal foil, such as aluminum, adhered to a microwave susceptor sheet stock having a dielectric support layer and a heater layer of microwave interactive material allowing passage of microwave energy as it is heated thereby whereby the foil is heated by conduction from said susceptor stock when the susceptor stock is subjected to microwave radiation. A heating receptacle employing the composite sheet stock in a microwave oven can more closely simulate conventional oven conditions at a food surface adjacent the composite sheet stock because the foil layer blocks passage of microwave radiation whereby all microwave energy is converted to heat energy by the susceptor stock layer.

In accordance with more specific features of the invention, the metal foil layer is formed of aluminum foil, and the susceptor stock forms one outer surface of the composite sheet stock with the foil layer forming the opposite outer surface of the composite sheet stock. All microwave energy incident upon the susceptor stock surface will advantageously be converted to heat energy as it passes into the susceptor stock and is reflected back through it by the foil layer.

In accordance with other specific features of the invention, the metal foil layer has first and second surfaces and means for adhesion of a microwave susceptor stock layer onto each of the two surfaces. Heat energy is thereby provided at both surfaces of the composite sheet stock while microwave radiation is prevented from passing through the composite sheet stock. This advantageously permits residual microwave radiation passing through the body of the food article towards the composite sheet stock to further heat the susceptor layer adjacent the food article surface, whereby greater amounts of heat energy are provided at that food surface. The susceptor layer adjacent the food surface may be thinner than the other layer, as it would be subjected to lesser amounts of microwave radiation.

The primary object of the present invention is to provide a composite sheet stock for use in a microwave oven which will closely simulate conventional oven heat energy cooking conditions at a selected food article surface.

Another object of the invention is the provision of a composite sheet stock which can be used in a disposable, self-supporting microwave cooking receptacle for heating a selected surface of a food item in the receptacle by conduction of heat created by microwave absorption at the composite sheet.

A further object of the present invention is to provide a composite sheet stock for applying heat energy to a selected surface of a food article being heated in a microwave oven while preventing passage of microwave radiation through the composite sheet stock to the food surface.

Yet another object of the present invention is to provide a composite sheet stock for heating a food surface with heat energy in a microwave oven which converts substantially all the microwave energy incident upon the composite sheet stock to heat energy for conduction to the food surface.

BRIEF DESCRIPT10N OF THE DRAWINGS

FIG. 1 is a partially cross-sectioned, pictorial view of a packaged pizza segment containing a folded receptacle which can use the preferred embodiment of the present invention;

FIG. 2 is a partial, pictorial view of the receptacle in the collapsed, shipping configuration, as shown in FIG. 1, and further showing an enlarged partial view illustrating features of a sheet stock forming the receptacle;

FIG. 5 is a construction layout of the sheet stock blank as it is cut and serrated for assembly into the shape illustrated in FIGS. 1–4;

FIG. 6 is a sectional view showing operating characteristics of a receptacle of the type that can use preferred embodiment of the present invention;

DISCLOSURE

Figure 3:
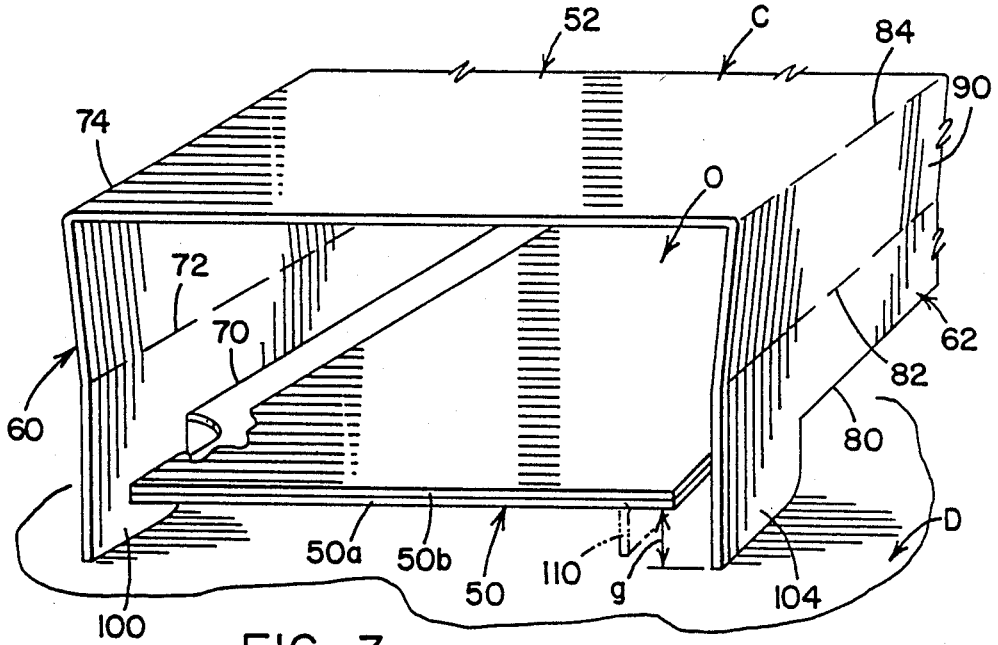
FIG. 3 is a view similar to FIG. 2 showing the receptacle of FIG. 1 in the manually assembled, free standing heating configuration, together with a modification of the package shown in phantom lines.

Referring now to the drawings wherein the showings are for the purpose of illustrating the preferred embodiment of the invention only, and not for the purpose of limiting same, FIGS. 1–4 illustrate a package A for shipping and distributing a frozen entree B such as a flat, elongated rectangular segment of pizza formed by placing on the upper surface of a bread layer 10 having a generally cup-shaped crust 10*a*, a topping layer 12 formed from sauce 14 and miscellaneous food items 16. The bread is baked, sliced and cut to size. Thereafter items 16 in a frozen condition and sauce 14 are spread on the upper surface of the bread. Package A is formed of paperboard and includes an outer shipping carton 20 of the type which is not microwave compatible and is selected for shipment purposes only. Food article B is wrapped in an air impermeable, plastic wrapper 22 which may be evacuated or filled with an inert gas. Article B is frozen and shipped in carton 20 for display in the freezer section of a retail outlet. Within carton 20 there is provided a disposable heating or reconstitution receptacle in the preferred form of sleeve C formed from the sheet paperboard blank, such as illustrated in FIG. 5. Sleeve C is formed from a microwave susceptor sheet stock 30 of the type disclosed in Seiferth U.S. Pat. No. 4,641,005. This susceptor sheet includes a generally continuous microwave interactive material 32 formed by vacuum depositing a thin layer of aluminum or similar metal onto a smooth plastic support film 34 which is, in turn, adhered to a flat, generally rigid paperboard 36 forming the support layer for microwave susceptor sheet 30. By changing the surface resistivity of microwave interactive material 32 through changing the thickness of this layer, the amount of heating caused at the layer of interactive material 32 can be modulated. In accordance with this embodiment, tbe interactive material is of the type having a surface resistivity of, between 13–16 ohms/inch and is constructed upon a 16 point paperboard which is a somewhat standard weight for the paperboard and is rigid as a standard poster stock. Such microwave susceptor sheet stock material, but with a higher resistivity, is well known in the art and is widely used for microwave heating of various food products. The selection of a low surface resistivity on a firm or generally rigid 16 point paperboard for an encircling free standing sleeve C is believed to be novel. This combination of strength and high heating by low resistivity is a further advantage of the present invention.

Figure 4:
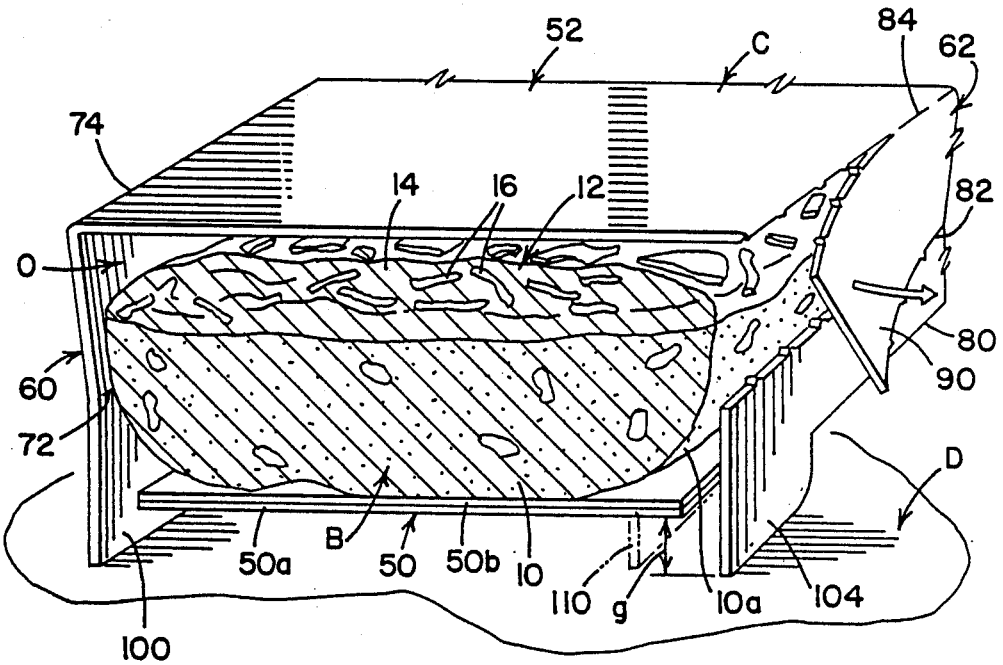
FIG. 4, is a view similar to FIG. 3 with the pizza inserted into a sleeve of the type of can use the present invention.

Referring now more particularly to sleeve C, this sleeve includes two parallel, generally flat portions 50, 52 which are adapted to be located on opposite sides of the food item B during tbe microwave heating operation. In accordance with the present invention, lower or bottom flat portion 50 is formed from two separate layers 50*a*, 50*b* of microwave susceptor sheet stock 30. Consequently, sleeve C comprises parallel flat portions 50, 52 with lower or bottom portion 50 formed by two separate and distinct interactive layers 50*a*, 50*b*. To interconnect parallel, flat portions 50, 52 sleeve C includes integral side walls 60, 62. Wall 60 includes parallel cut lines or serrated seams 70, 72, and 74. In a like manner, wall 62 includes cut lines or serrated seams 80, 82, and 84. By incorporating these seams sleeve C can be folded into a collapsed condition, as shown in FIG. 1, or can be manually expanded into the operative, heating configuration, as shown in FIGS. 3 and 4. To allow easy removal of the heated pizza segment or food item B, after the microwave reconstitution, seams 82, 84 are formed into parallel tear lines so that tear strip 90 can be manually removed from side wall 62. This opening feature allows easy removal of the heated food article and assures that sleeve C will be disposed of since sleeve C is generally of no use after tear strip 90 has been removed.

To assure that microwave energy enters through lower portion 50, to heat susceptor layers 50*a*, 50*b*, lower portion 50 must be spaced from the lower wall D of the microwave oven during the heating process. This spacing can be maintained in accordance with the preferred embodiment, by a plurality of integrally formed downwardly depending legs 100, 102, 104 and 106 which are folded into a generally flat condition when sleeve C is collapsed, as shown in FIGS. 1 and 2, and are moved to downwardly depending positions, as shown in FIGS. 3 and 4, when sleeve C is manually formed into its heating or operative configuration. These legs are cut from the microwave interactive material 30, as best illustrated in FIG. 5.

Sleeve C is self-supporting. It is collapsed or folded and shipped in a generally flat condition in package A, as shown in FIG. 1 and FIG. 2. When article B is to be reconstituted, it is removed from package 22, the sleeve is manually assembled into the configuration shown in FIG. 3 and the pizza or article is slipped longitudinally into the sleeve, as shown in FIG. 4. Side walls 60, 62 extend upwardly along the vertical portion of crust 10*a*. Sleeve C loaded with article B is positioned on lower wall D of the microwave oven and the oven is energized to cook, bake or otherwise reconstitute the frozen food entree or food article B.

Figure 7A:
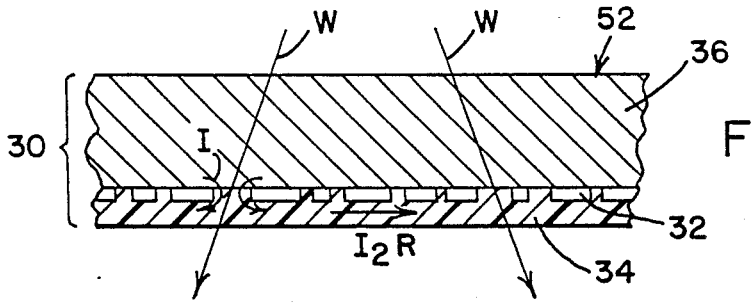
FIG. 7A is an enlarged section illustrating the circular portion 7A of FIG. 6.
Figure 7B:
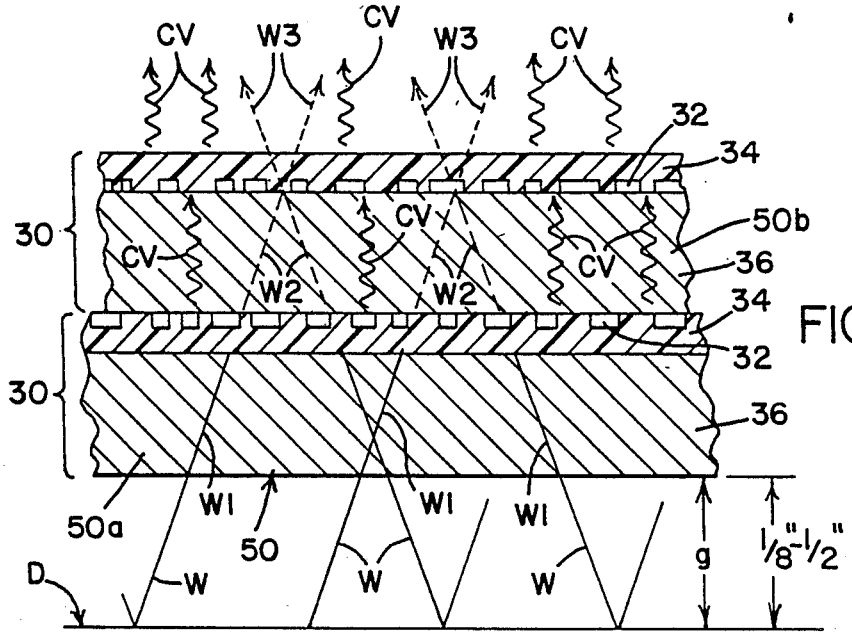
FIG. 7B is an enlarged section illustrating the circular portion 7B of FIG. 6.

Referring now to FIGS. 6, 7A and 7B, the operating characteristics of the illustrated embodiment of the present invention, as shown in FIGS. 1–5, are shown graphically and in a general manner so that these features can be appreciated even tbough such appreciation would be well known to persons skilled in the art. Certain specific operating characteristics do form aspects of the present invention. For instance one aspect of the invention is to convert all of the microwave energy passing into sleeve C from the bottom portion 50 into heat for radiation, conduction, or convection into the lower bread layer 10. This is required to practice the invention and is employed as a general objective or feature of the invention. As shown in FIG. 6, microwave energy, indicated as rays W, is shown as penetrating through upper parallel portion 52. During this penetration, rays W give up a certain amount of energy to heat the interactive material layer 32. Thus, the inner chamber O of self-supporting receptacle C is a small oven chamber wherein heat is radiated from that portion of the susceptor sheet 30 forming upper portion 52. A substantial amount of the microwaves, indicated as rays W, pass through material 30 and enter oven chamber O for the purposes of heating the upper portion of pizza segment B by dielectric heating. The microwave heats the topping which is lossy material and portion 52 radiates heat to the topping. Combined radiating and microwave absorption, together with slight convection, causes oven chamber O to heat the topping efficiently, but at a lower temperature level than needed to heat bread 10 and make crust 10*a* crisp. If the microwave susceptor material 30 forming sleeve C had only a single layer at bottom flat portion 50, then the same type of strong microwave heating of bread layer 10 would occur. In accordance with the present invention, lower portion 50 of sleeve C can be modified to have two separate layers of microwave susceptor sheet stock 30, as shown in FIG. 7B. As rays W are reflected upwardly toward the vertically elevated, lower flat portion 50, they pass through the two sheets and are reduced in strength as represented by rays W3. To show this feature rays W enter paperboard 36 as rays W1. There is no appreciable energy absorption by the microwave transparent layer 36. The microwave rays then pass through the first interactive layer 32 which removes a substantial amount of energy from rays W1. The amount of absorption is controlled by the amount of metal in layer 32 which is expressed as surface resistivity of interactive layer 32. This energy absorption by layer 32 of layer 50*a* causes a weaker microwave energy ray illustrated schematically as rays W2 that are shown as progressing upwardly through the second layer 50*b* where it interacts with microwave interactive layer 32 of layer 50*b* which converts even more of microwave energy in original ray W into heat. Only a minor portion, if any, of the original microwave radiations, illustrated as rays W, passes through second layer 50*b*. This negligible amount is shown as rays W3, which may be substantially zero. Thus, the lower portion 50*a* is heated by microwavable interactive layer 32. Heat energy is conducted from this first layer as indicated by the serpentine lines CV to direct beat upwardly through the second layer 50*a*. This conducted heat combines with the further heat generated at the second interactive layer 32 to convert a major portion of the incoming microwave energy into heat energy as indicated by further, lines CV above layer 50*b*. Board 36 of lower layer 50*a* insulates sleeve C so that the conducted heat energy generally moves upwardly through upper portion or layer 50*b* to combine with the heat created in this layer. There is, thus, a high heat concentration at lower crust 10*a*. To enhance this operation, the second layer could be provided in the vertical areas of crust 10*a* adjacent side walls 60, 62. As indicated in FIG. 7A, the heating effect is caused by induced flow of current I when microwaves W pass through an interactive layer 32 of susceptor sheet 30; therefore, penetration by radiation or rays is generally required for the purpose of causing heating of the interactive material. To provide reflected radiation, portion 50 is spaced a distance g from wall D. This spacing is in the range of $\frac{1}{8}$–$\frac{1}{2}$ inch and can be provided by legs 100, 102, 104 and 106, as previously described.

By employing a receptacle constructed in accordance with the invention there is created a unique heating concept. The lower portion of the layered food article is heated by heat energy emanating from a susceptor, while still using an encircling sleeve which is substantially rigid and convertible between a flattened, folded sleeve to a free standing, self-supporting heating configuration. The sheet material 30 includes a relatively stiff or rigid paperboard that can retain a shape to define a heating oven chamber O in which heat energy emanates from the oven walls by means of radiation, conduction, or convection. The novel sleeve is a receptacle for heating the article, as opposed to some type of general heat conducting material wrapped around the article and having a shape determined by the article. To add rigidity to this particular construction, the lower layer 50*a* can be provided with a downwardly and transversely extending rib 110, shown in phantom lines in FIGS. 2–4. This rib allows use of a thinner paperboard while maintaining the necessary gap g under lower portion 50. Of course, other downwardly depending tabs and ribs could be provided for further enhancing the rigidity of lower portion 50 to prevent undue sagging of this lower support portion of sleeve C. The self-sustaining, disposable sleeve, including surrounding microwave interactive sheet material 30 with at least two layers coterminous with at least the lower flat portion 50 produces the advantages of conventional oven type heating at the crust.

Figure 8:
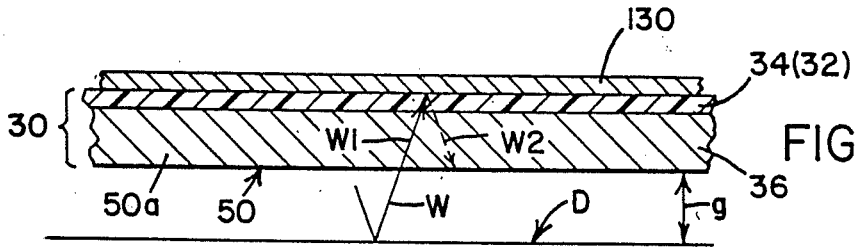
FIG. 8 is an enlarged cross sectional view of a composite sheet stock formed in accordance with the present invention.
Figure 9:
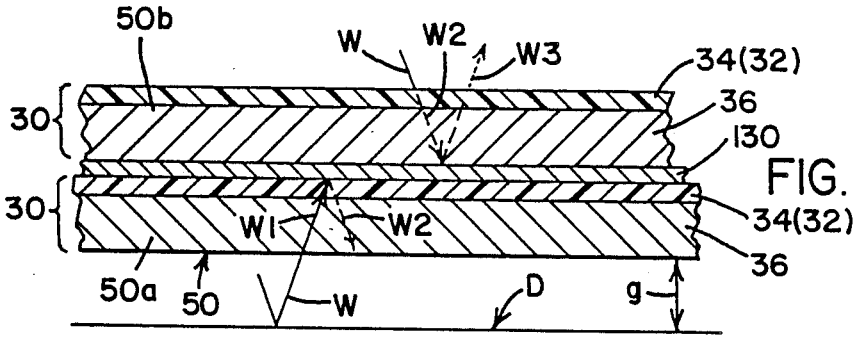
FIG. 9 is an enlarged cross sectional view of an alternate embodiment of a composite sheet stock formed in accordance with the present invention.
Figure 10:
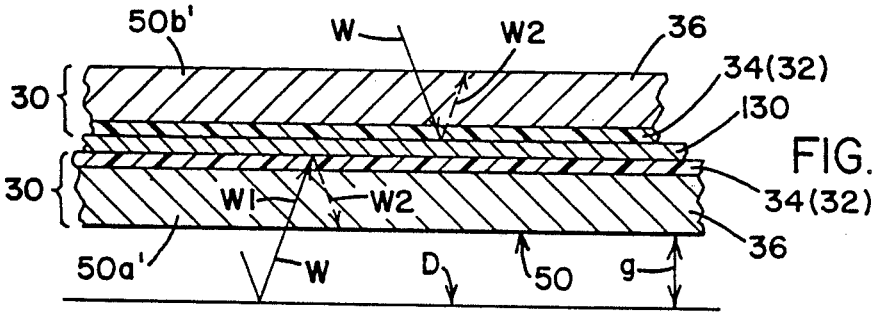
FIG. 10 is an enlarged cross sectional view of another alternate embodiment of a composite sheet stock formed in accordance with the present invention.

Referring now to FIG. 8, in accordance with the preferred embodiment of the invention the lower layer 50*a* is covered by a heat conduction layer 130 so that heat generated in lower surface 50*a* is conducted through this heat conductive layer 130 onto bread layer 10 to cause high heat at crust 10*a*. In the preferred embodiment, this conductive layer 130 is aluminum foil that reflects microwave energy. Thus microwave energy passing through reactive layer 32 of lower layer 50*a* causes $I_2R$ heating as the rays pass toward and away from the metal foil of reflective layer 130. This dual action of the rays enhances the heating effect of lower layer 50*a*, which, in turn, causes the temperature surface 130 to be relatively high. Further, the reflective nature of metal layer 130 sbields crust 10*a* against microwaves from lower portion 50 of sleeve C. Thus, all heat at the surface of crust 10*a* emanates from heated layer 130. A further modification of the invention shown in FIG. 8 is shown in FIG. 9 wherein the heat conduction layer 130 is located between lower layers 50*a*, 50*b*. In this construction, microwave energy which happens to pass downwardly through topping 12 and bread layer 10 is converted into heat energy by the uppermost layer 50*b* of lower portion 50. A modification of this concept is illustrated in FIG. 10 wherein layer 50*b'* is similar to layer 50*b* except it is laminated in the reverse position. The interactive material 32 of layer 50*b'* is adjacent aluminum foil 130. The various configurations illustrated in FIGS. 8–10 are for the purpose of illustrating certain modifications which can be employed in practicing the present invention.

In accordance with the commercial embodiment of the invention, the microwave susceptor sheet stock material is purchased from James River Corporation of Richmond, Va. and has 16 point board with 13–16 ohms/inch.

Having thus described the invention, the following is claimed:

1. A disposable receptacle for heating of a food article by microwave energy, said receptacle having at least a portion thereof formed from a sheet stock which is bent and folded into a configuration having a flat suface portion therof adapted to be in contact with said food article which rests thereon, said portion having an outer peripheral shape generally at least as large as the peripheral shape of said food article, said portion comprising;

a composite, laminated sheet stock for heating, principally by conduction, the surface of a food item in contact with said flat surface portion by microwave energy, said sheet stock including a layer of microwave opaque metal foil adhered to a microwave susceptor sheet stock, said susceptor sheet stock having a dielectric support layer of paper board and a heater layer of microwave interactive material in the form of vacuum deposited aluminum on a plastic sheet, said heater layer having a surface resistivity of less than 16 ohms/inch and allowing passage of microwave energy as said heater layer is heated by microwave energy, said heater layer laminated between said paper board layer and said metal foil whereby said foil is heated by conduction from said susceptor sheet stock when said susceptor stock is subjected to direct microwave radiation by the energy source and reflective microwave radiation from said foil.

2. The composite, laminated, sheet stock of said receptacle as defined in claim 1 wherein said metal foil has first and second co-extensive surfaces and meals for adhering said microwave susceptor sheet stock onto said first surface, and further including a second layer of microwave susceptor sheet stock and means for adhering said second microwave susceptor sheet stock onto said second surface of said metal foil whereby said foil is heated by conduction at its first and second surfaces from both said first and second susceptor sheet stock when said susceptor stocks are subjected to direct and reflective microwave radiation, and said paper board is about a 16 point paper board stock.

3. The composite, laminated sheet stock of said receptacle as defined in claim 2 wherein said second susceptor sheet stock has a dielectric support layer of paper board and a heater layer of microwave interactive material in the form of vacuum deposited aluminum on a plastic sheet, said heater layer having a surface sensitivity of less than 16 ohms/inch and allowing passage of microwave energy as said heated layer is heated, said heater layer of said second susceptor laminated between said metal foil's second surface and said paper board to additionally provide direct conduction of heat from said second heat layer to said second surface of said metal foil.

4. The composite, laminated sheet stock of said receptacle as defined in claim 2 wherein said second susceptor sheet stock has a dielectric support layer of paper board and a heater layer of microwave interactive material in the form of vacuum deposited aluminum on a plastic sheet, said heater layer having a surface sensitivity of less than 16 ohms/inch and allowing passage of microwave energy as said heated layer is heated, said second susceptor sheet's paper board laminated to said second surface of said metal foil and said plastic sheet of said second susceptor adapted to be in contact with said surface of said food item.

5. The receptacle of claim 2 wherein said receptacle comprises a pop-up sleeve formed of a single layer of said microwave susceptor sheet stock, said sheet stock including a portion having said metal foil adhered thereto comprising said composite sheet stock and a portion of said susceptor stock folded over said first portion, said folded over portion comprising said second layer.

* * * * *